US005863195A

United States Patent [19]

Feldermann

[11] Patent Number: 5,863,195

[45] Date of Patent: Jan. 26, 1999

[54] OXYGEN-FUEL BURNER

[75] Inventor: Christian J. Feldermann, Eckington, England

[73] Assignee: The BOC Group plc, Windlesham Surrey, England

[21] Appl. No.: 906,225

[22] Filed: Aug. 4, 1997

[30] Foreign Application Priority Data

Aug. 5, 1996 [GB] United Kingdom ..... 9616442

[51] Int. Cl.[6] ..... F23D 14/22

[52] U.S. Cl. ..... 431/186; 431/181; 431/187; 431/8; 431/10; 431/12

[58] Field of Search ..... 431/8, 9, 10, 12, 431/181, 182, 190, 187, 188, 186, 189, 159, 353; 239/406, 424.5, 433

[56] References Cited

U.S. PATENT DOCUMENTS 2,500,787 3/1950 Legemann .
2,567,485 9/1951 Jenny .
4,014,639 3/1977 Froehlich ..... 431/182
5,256,352 10/1993 Snyder ..... 239/433
5,393,220 2/1995 Couwels et al. ..... 431/10
5,554,022 9/1996 Nabors, Jr. et al. ..... 431/10

FOREIGN PATENT DOCUMENTS 1376395 12/1974 United Kingdom ..... 431/8

OTHER PUBLICATIONS wo 89/02051, IPC Saltin, Mar. 1989.

*Primary Examiner*—Carl D. Price
*Attorney, Agent, or Firm*—David M. Rosenblum; Salvatore P. Pace

[57] ABSTRACT

A burner is provided with a burner block having a recess formed in the back thereof for receiving a fuel atomiser and a plurality of oxygen inlets for creating a converging cone of oxygen for intersection with any fuel issuing from the atomiser. Such an arrangement also provides a protective wall for protecting the atomiser from the harsh environment to which the burner is exposed and simplifies the oxygen supply arrangements.

12 Claims, 2 Drawing Sheets

OXYGEN-FUEL BURNER

BACKGROUND OF THE INVENTION

The present invention relates to a burner and relates particularly, but not exclusively, to a burner having a comparatively short flame length.

WO89/02051 discloses an oxygen-fuel burner and a method of generating an oxidising flame. The burner includes a central body with a central oxygen nozzle and at least one fuel nozzle, a casing surrounding the central body, at least one peripheral oxygen nozzle radially outside the fuel nozzle, and an oxygen chamber outside the central body, all nozzles being at least substantially parallel. The central oxygen nozzle and the peripheral oxygen nozzle are connected to different sources of oxygen such that it is possible to deliver oxygen at different pressures to each nozzle. Such an arrangement creates a rather laminar fuel and oxygen flow which is not conducive to good mixing and results in a flame length somewhat longer than might be desired. Whilst this can be an advantage in some situations, i.e. where protection of the burner tip is desirable, this burner does not lend itself to use in situations where it is desirable to create a fully developed flame at a point comparatively close to the burner tip.

Also known is a modification of the above burner in which a fuel atomiser is positioned centrally within the burner body and oxygen is used to atomise fuel oil which is then directed downstream thereof and mixed with a further stream of oxygen before being combusted. This arrangement exposes the comparatively expensive atomiser to the hostile environment associated with the application in which the burner is situated and, where metal is being melted, molten metal will often splash the atomiser thereby damaging it and reducing its effectiveness. Once damaged, such atomisers become comparatively inefficient and require replacements which can only be achieved by dismantling the burner. Clearly, this is extremely undesirable, particularly when the burner is used in a continuous process.

SUMMARY OF THE INVENTION

It is an object of the present invention to provide an oxygen-fuel burner which reduces and possibly eliminates the problems associated with the above-mentioned designs.

Accordingly, an oxygen-fuel burner comprises: a combustion chamber, having a first inlet end, a second outlet end for combustion flame discharge and a longitudinal axis X; fuel supply means, for introducing a stream of fuel to the chamber; oxygen supply means for introducing air and/or oxygen to the chamber and a burner block for receiving said fuel and oxygen/air and for directing it downstream thereof, in which a rear surface of the burner block includes a recess in which is positioned a fuel atomising nozzle and the front surface includes a central fuel outlet positioned on or near the central axis X and through which atomiser fuel is directed, said burner block further comprising a plurality of first oxygen outlets for supplying a first stream of oxygen to a position radically outward of said fuel stream, said first oxygen outlets being angled inwardly at an angle θ relative to longitudinal axis X thereby to create a generally converging stream of oxygen for intersection with any fuel flow from the central fuel outlet.

Such a burner produces a relatively short, two-stage flame with a high velocity. Typically, gases are ejected from the burner nozzle at about 100–150 $ms^{-1}$ and are accelerated due to the increase in flame temperature up to a speed approaching or exceeding sonic speed (about 300 $ms^{-1}$).

Advantageously, the burner block further includes a plurality of second oxygen outlets radially outward of said first oxygen outlets and being angled inwardly at an angle Ø relative to longitudinal axis X and in which angle Ø is less than angle θ such that the second oxygen outlets create a generally converging second oxygen stream for intersection with any fuel flow at a position axially downstream of the point at which the first oxygen stream intersects said fuel stream.

Preferably, the second oxygen outlets are angled at an angle Ø of between about 0° and about 10° relative to a longitudinal axis X.

Advantageously, the burner includes translation means for moving the burner block axially along axis X thereby to vary the flame length of any flame issuing from said burner.

Preferably, the translation means comprises a fuel supply duct extending along the chamber and positioned for delivering fuel to the atomiser and an actuator for causing said fuel supply duct and hence the burner block to move axially along axis X.

Preferably, the burner includes means for varying the atomising pressure within the atomiser, thereby to vary the flame length of any flame issuing from said burner.

Conveniently, the fuel atomising nozzle includes means for receiving natural air as an atomising fluid.

Alternatively, the atomising nozzle includes means for receiving oxygen as an atomising fluid.

Conveniently, the atomising oxygen and the oxygen supplied to the oxygen outlets comprise the same source.

Preferably, the central fuel outlet comprises an outlet of smaller diameter than the recess through which fuel is atomised as it exits the outlet.

BRIEF DESCRIPTION OF THE DRAWINGS

Conveniently, the central fuel outlet comprises an outlet having a generally divergent cross-sectional form.

The present invention will now be more particularly described by way of example only with reference to the following drawings in which.

DETAILED DESCRIPTION

Figure 1:
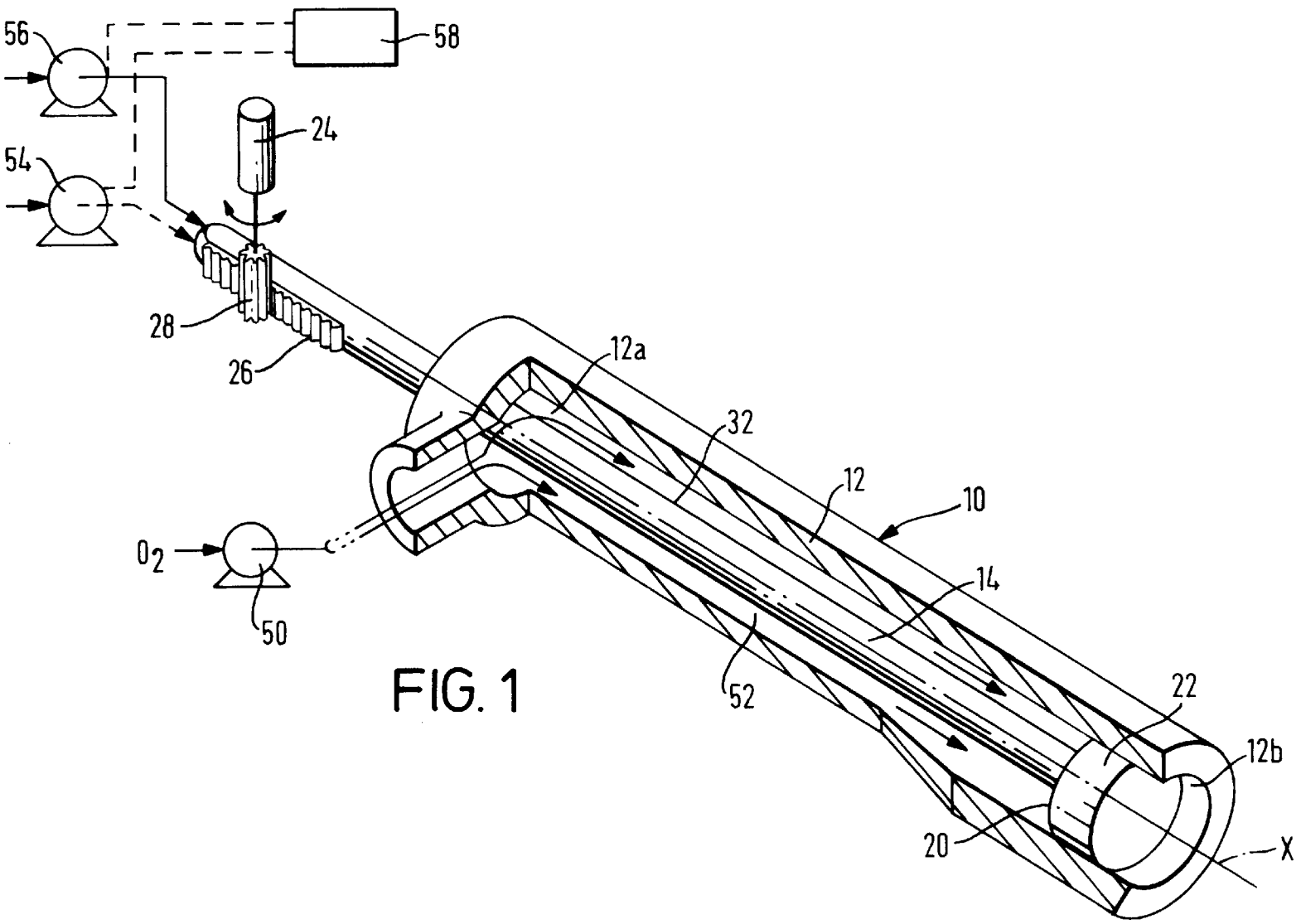
FIG. 1 is a perspective view, partially in section, of an oxygen-fuel burner embodying the present invention.

Referring now to the drawings in general, but more particularly to FIG. 1, a burner 10 comprises a generally cylindrical jacket 12 having a first inlet end 12*a*, a second outlet end 12*b* for combustion flame discharge and a longitudinal axis X. A fuel supply means in the form of, for example, duct 14 extends through jacket 12 and terminates at an atomiser 16 positioned within a recess 18 in the rear surface 20 of a burner block 22, all of which arc best seen in FIG. 2. The burner block comprises a metal such as, for example, INCO ALLOY. The fuel supply duct 14 and burner block 22 are mounted for axial movement within chamber 12 and along axis X by means of motor 24 and rack and pinion arrangement 26, 28 positioned towards a distal end of fuel duct 14. The burner block 22 is recessed about 50–75 mm from the outlet end 12*b* of the burner 10, and is axially movable through about 100–150 mm.

Figure 2:
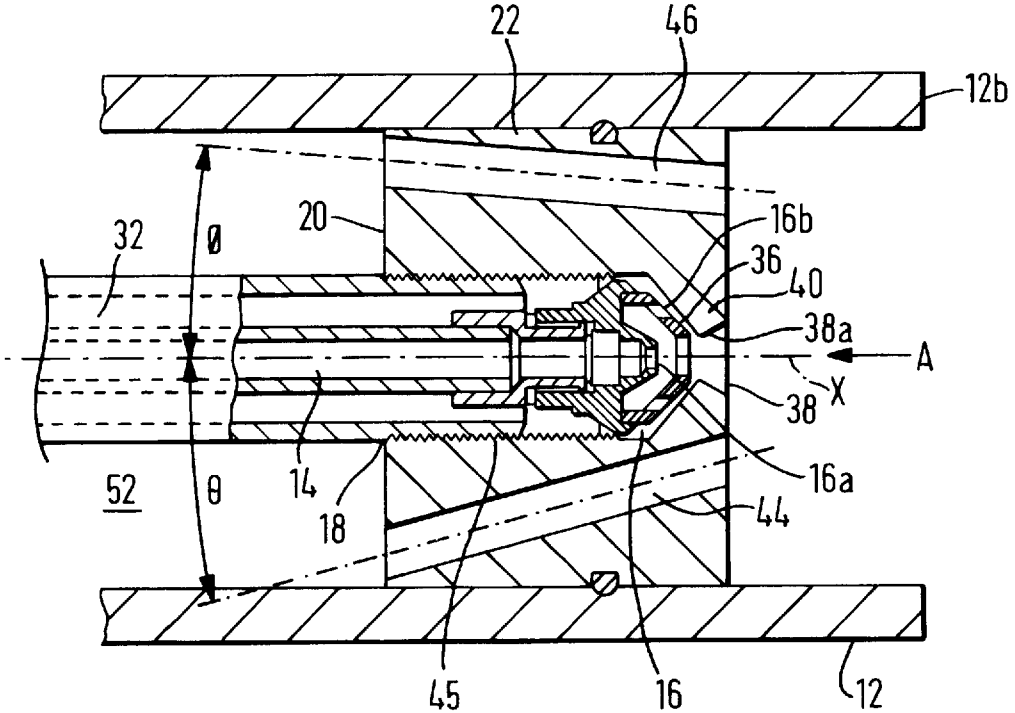
FIG. 2 is a cross sectional view of the burner block and atomising nozzle illustrated in FIG. 1.

Referring now more particularly to FIG. 2, it will be appreciated that atomiser 16 is of conventional form and therefore not described in detail herein. However, such an atomiser generally includes a central fuel supply outlet 16*a* and a plurality of circumferentially spaced apertures 16*b* for supplying an atomising fluid such as natural air or oxygen. In the arrangement of FIG. 2, the fuel supply duct 14 further includes an annular air/oxygen supply duct 32 positioned therearound and shaped for supplying atomising fluid to outlets 16*b*. Other arrangements will, however, present themselves to a person skilled in the art. The downstream end of atomiser 16 is formed by the burner block itself which is provided with a suitable confronting surface 36 and effectively replaces the outer casing of a conventional atomiser. The burner block 22 further includes a central fuel outlet 38 of smaller diameter than recess 18 and hence forms a wall of metal 40 surrounding the atomiser and which acts to protect said atomiser from the environment in which the burner is situated. In particular, wall 40 will prevent splashes of molten metal from contacting the surface of the atomiser 16 and thus eliminate damage thereof. The central fuel outlet 38 is provided with a generally diverging surface 38*a* shaped to complement the desired spray pattern. For convenience, nozzle 16 is threadably engaged at 45 to burner block 22. Other methods of engagement will, however, present themselves. A person skilled in the art will readily appreciate the advantages associated with protecting the atomiser 16 in the manner shown in FIG. 2 and will also appreciate that the burner flame pattern may also be altered by altering the atomiser 16 itself, each atomiser having a different spray pattern associated therewith.

Figure 3:
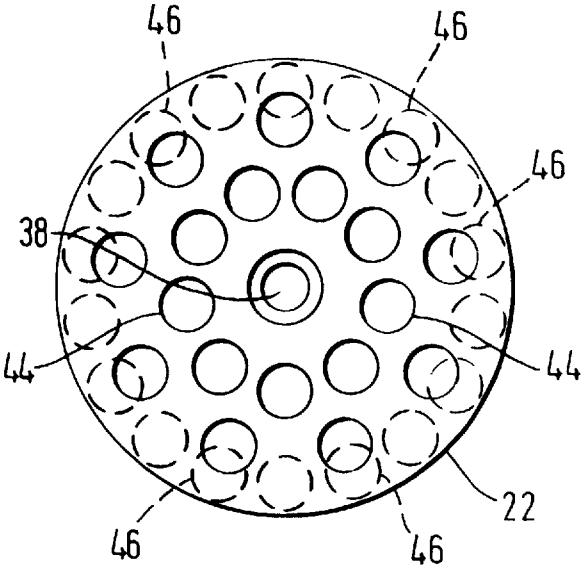
FIG. 3 is an end elevation of the burner block taken in the direction of arrow A in FIG. 2.

Referring now generally to FIGS. 2 and 3, it will be seen that the burner block 22 further includes a plurality of first oxygen outlets 44 for supplying a first stream of oxygen to a position radially outward of any fuel stream exiting central fuel outlet 38. The first oxygen outlets being circumferentially spaced around outlet 38 and being angled inwardly at an angle θ to longitudinal axis X thereby to create a generally converging stream of oxygen for intersection with the fuel flowing from outlet 38. The angle θ of the primary oxygen outlets 44 (steepest angled holes) is the main parameter in changing or varying the flame length, the angle of which may be between about 0° to about 20° which will provide a reduction in flame length of up to about 50% compared with a nozzle having straight holes. Typically 0° will give a flame length of about 3 m and about 20° a flame of about 1.3 m length. A plurality of second oxygen outlets 46 are provided radially outwards of said first outlets 44 and are angled inwardly at an angle Ø relative to a longitudinal axis X. Angle Ø being less than angle θ such that the second oxygen outlets 46 create a generally converging oxygen stream for intersection with any fuel flow at a position axially downstream of the point at which the first oxygen stream intersects said fuel stream. The angle of the second oxygen outlets 46 is responsible for the final shape and temperature distribution of the flame. Typically, an angle Ø of about 10° will narrow the flame and increase its temperature closer to the burner tip by comparison with nozzles having straight holes i.e. 0°. Consequently, it will be possible to alter and/or move the 'hot spot' of the flame to suit a particular requirement. For example, a distant hot spot is often desirable in a rotary furnace.

In the particular arrangement of the present invention, oxygen is supplied via pump 50 into an annular duct 53 formed between chamber 12 and fuel supply duct 14 such that it impinges on the back surface 20 of burner plate 22 and is caused to enter oxygen outlets 44, 46 before issuing therefrom. Such an arrangement avoids the requirement for comparatively expensive and complicated individual pipes to each and every oxygen outlet. Referring once again to FIG. 1, pumps 54 and 56 are provided for supplying fuel and atomising fluid respectively to nozzle 16 and each are individually controllable with control apparatus 58 to vary the supply rate and pressure of said fluids to said nozzle 16, thereby to cause a variation of the flame length of any flame issuing from said burner.

Whilst it will be appreciated that, in a particularly convenient arrangement, the atomising fluid might comprise oxygen from the same source as that provided to pump 50 it will be possible to use natural air rather than comparatively expensive oxygen. Consequently, atomisation of the fuel may be achieved at comparatively low cost without compromising the thermal efficiency or performance of the burner itself.

In operation, the burner provides a two-stage flame commencing some 1–2 inches or so from end 12*b* and extending as little as 1.3 m therefrom. The flame length of a burner incorporating the present burner block arrangement 22 is some 25% reduced by comparison with presently known arrangements. Additionally, the provision of first and second oxygen outlets 44, 46 and the angling thereof facilitates the provision of a staged combustion process which significantly reduces the emissions associated with such burners. Tests have demonstrated a reduction of over 40% in the $NO_x$ levels compared with more conventional burners. Also, the present burner provides excellent flame characteristics with light fuel oil using both oxygen and air for itemisation. Heavy fuel oil gave a very good result using oxygen, while the use of atomising air can result in a slightly unstable flame at higher firing rates. This is possibly due to the cooling of the liquid fuel oil through the increased amount of air and thus a change in its viscosity. Retraction of the present burner will cause the jacket to have an effect on the flame shape in a manner well known to those skilled in the art and therefore not described herein.

The burner of the present invention is suited to produce a relatively short, two-stage flame at high velocity (300 $ms^{-1}$ or more), which is of particular suitability for Electric Arc Furnaces, and also for calcination furnaces (for producing lime, alumina and the like).

I claim:

1. An oxygen-fuel burner comprising:

an outer jacket having a first inlet end, a second outlet end for combustion flame discharge, and a longitudinal axis X;

fuel supply means for introducing a stream of fuel to a chamber;

oxygen supply means for introducing an oxidant formed of one of air, oxygen, or both air and oxygen to the chamber; and a burner block for receiving said fuel and said oxidant and for directing said fuel and oxidant downstream thereof, and having rear and front surfaces the rear surface of the burner block including a recess in which is positioned a nozzle of a fuel atomiser;

the front surface of the burner block including a central fuel outlet positioned at least near the longitudinal axis X and through which atomised fuel from said fuel atomiser is directed;

said burner block further comprising a plurality of first oxygen outlets for supplying a first stream of oxygen to a position radially outward of said fuel stream, said first oxygen outlets being angled inwardly at an angle θ relative to longitudinal axis X thereby to create converging first streams of oxygen intersecting said longitudinal axis X and therefore atomised fuel from the central fuel outlet.

2. The oxygen-fuel burner as claimed in claim 1 in which the burner block further includes a plurality of second oxygen outlets radially outward of said first oxygen outlets and being angled inwardly at an angle Ø relative to longitudinal axis X and in which angle Ø is less than angle θ such that the second oxygen outlets create converging second oxygen streams for intersection with atomised fuel at a position axially downstream of the point at which the first oxygen streams intersect said fuel stream.

3. The oxygen-fuel burner as claimed in claim 2 which the second oxygen outlets are angled at an angle Ø of between about 0° and about 10° relative to longitudinal axis X.

4. The oxygen-fuel burner as claimed in claim 1 in which the first oxygen outlets are angled at an angle θ of between about 0° and about 20° relative to longitudinal axis X.

5. The oxygen-fuel burner as claimed in claim 1 including translation means for moving the burner block axially along the longitudinal axis X relative to the nozzle of the fuel atomiser thereby to vary the flame length of any flame issuing from said burner.

6. The oxygen-fuel burner as claimed in claim 5 in which the translation means comprises a fuel supply duct extending along the chamber and positioned for delivering fuel to the atomiser and an actuator for causing said fuel supply duct and hence the burner block to move axially along longitudinal axis X.

7. The oxygen-fuel burner as claimed in claim 1 including means for varying the atomising pressure within the fuel atomiser, thereby to vary the flame length of any flame issuing from said burner.

8. The oxygen-fuel burner as claimed in claim 1 in which the nozzle of the fuel atomiser includes means for receiving natural air as an atomising fluid.

9. The oxygen-fuel burner as claimed in claim 1 in which the nozzle of the fuel atomiser includes means for receiving oxygen as an atomising fluid.

10. The oxygen-fuel burner as claimed in claim 9 in which the oxygen supplied to the fuel atomiser and the oxygen outlets comprises the same source.

11. The oxygen-fuel burner as claimed in claim 1 in which the central fuel outlet comprises an outlet of smaller diameter than the recess through which fuel is atomised as it exits the outlet.

12. The oxygen-fuel burner as claimed in claim 1 in which the central fuel outlet comprises an outlet having a generally divergent cross-sectional form.

* * * * *